US006456911B1

(12) United States Patent
Muramatsu

(10) Patent No.: US 6,456,911 B1
(45) Date of Patent: Sep. 24, 2002

(54) TRAFFIC SUPPORT SYSTEM

(75) Inventor: Hideo Muramatsu, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 4 days.

(21) Appl. No.: 09/658,470

(22) Filed: Sep. 8, 2000

Related U.S. Application Data

(63) Continuation of application No. PCT/JP00/01785, filed on Mar. 23, 2000.

(30) Foreign Application Priority Data

Apr. 16, 1999 (JP) ..... 11-109221

(51) Int. Cl.[7] ..... G08G 1/123

(52) U.S. Cl. ..... 701/25; 701/35; 701/200; 340/988; 340/994; 73/178 R

(58) Field of Search ..... 701/24, 25, 200, 701/202, 201, 213, 215, 216, 35, 33; 455/12.1, 427, 428; 340/426, 988, 994, 990; 73/178 R

(56) References Cited

U.S. PATENT DOCUMENTS 6,006,159 A * 12/1999 Schmier et al. ..... 701/200

FOREIGN PATENT DOCUMENTS

| | | |
|---|---|---|
| JP | 5-6137 | 1/1993 |
| JP | 6-44425 | 2/1994 |
| JP | 7-318361 | 12/1995 |
| JP | 8-122090 | 5/1996 |
| JP | 9-505485 | 2/1997 |

* cited by examiner

*Primary Examiner*—Jacques H. Louis-Jacques
*Assistant Examiner*—Arthur D. Donnelly
(74) *Attorney, Agent, or Firm*—Oblon, Spivak, McClelland, Maier & Neustadt, P.C.

(57) ABSTRACT

In a traffic support system, journey information creating means is incorporated in an information processing device formed as a work station. On the basis of information concerning the journey of an airplane and accumulated as a database, and information recorded in a data recording device and obtained each time the airplane travels, the journey information creating means creates new information for the next journey of the airplane. This created information is recorded in the data recording device and brought into the airplane. Accordingly, information obtained while a mobile body travels can be used in subsequent journeys of the mobile body, thereby further enhancing the convenience of the system.

2 Claims, 2 Drawing Sheets

TRAFFIC SUPPORT SYSTEM

CROSS-REFERENCE TO RELATED APPLICATIONS

This is a Continuation of Application PCT/JP00/01785, filed Mar. 23, 2000.

This application is based upon and claims the benefit of priority from the prior Japanese Patent Application No. 11-109221, filed Apr. 16, 1999, the entire contents of which are incorporated herein by reference.

BACKGROUND OF THE INVENTION

This invention relates to a traffic support system, and more particularly to a traffic support system such as a navigation system to be used for supporting the journey of a mobile body such as an airplane, an automobile, etc.

A system installed in a mobile body, such as an airplane or an automobile, for supplying various information items that are necessary for the journey of the mobile body or enable it to travel smoothly, i.e. a navigation system, is now being proposed. This system is adapted, for example, to read data from a recording medium such as a CD-ROM or a hard disk, and to calculate, for example, an optimal route to a destination on the basis of data manually input by the user or on the basis of map information, destination information or position information supplied from, for example, an inertial navigation system installed in the mobile body. This route is displayed on a display incorporated in the navigation system in order to facilitate better navigation by the driver or pilot.

Techniques concerning such a navigation system are publicly known from, for example, Japanese Patent Application KOKAI Publications Nos. 7-318361 and 8-122090.

The navigation systems introduced by these publications incorporate a recording medium that records information such as destination information. They also include a data recording/inputting unit for inputting data provided such that it can be separated from the main system, thereby enabling input of data outside the vehicle, which cannot be realized by the previous navigation systems. Thus, the disclosed systems have good operability.

Further, Japanese Patent Application KOKAI Publication No. 5-6137 proposes another system. The navigation system disclosed therein uses a programmable recording medium such as an optical disk memory, in which data can be written. This enables the user to add private information, such as the telephone number of a restaurant where the user repeatedly visits, to fixed information such as map information supplied from the manufacturing enterprise in the form of a CD-ROM. As a result, the convenience-of the system to the user enhances.

As described above, various types of systems, which are obtained by improving the currently-used navigation systems so as to further enhance its convenience to the user, are now being proposed.

On the other hand, a system represented by a VICS (Vehicle Information Communication System) has recently come into practical use, which can provide a navigation system with information such as traffic jam information, parking information, etc. from the outside in a realtime manner. Thus, this system can provide the user with much more information. Information from the VICS is supplied to each navigation system by radio transmission.

Thus, the navigation system is provided with various information items by the user's data input, from, for example, a position recognizing device installed in the mobile body, or from an outside facility. The navigation system processes the supplied data and creates new information concerning, for example, an optimal route to the destination.

The information obtained while traveling, however, is used up and exhausted all at once. In other words, the conventional navigation system does not have a function for recording, processing and accumulating various information items obtained while traveling to enable effective use of the resultant data at the next journey.

BRIEF SUMMARY OF THE INVENTION

It is the object of the invention to provide a traffic support system capable of using, in subsequent journeys, data obtained by a mobile body while traveling, thereby making the system much more convenient.

The word "use" indicates not only the use of information obtained by a mobile body while traveling, but also the use of information having its convenience enhanced by processing such as statistical processing.

The invention provides a traffic support system for providing a user with information concerning a journey of a mobile body, comprising:

recording means for recording information obtained while the mobile body travels;

database storing means for storing a database that is obtained by accumulating information concerning the journey of the mobile body; and information creating means for creating new information for the journey of the mobile body on the basis of the information recorded by the recording means and the information accumulated in the database, characterized in that the new information created by the information creating means is provided to the mobile body when it executes a next journey.

The above database contains, for example, traffic jam information recorded in the recording means each time the mobile body travels, information such as an optimal route, for example, created by the information creating means each time the mobile body travels, and information created by, for example, statistic processing based on these information items.

In the above structure, the recording means records information such as traffic jam information obtained while a mobile body such as an automobile travels. On the basis of this traffic jam information and past traffic jam information accumulated in the database, the information creating means creates jam information expected in the next journey of the mobile body, and also an optimal route based on this jam information. The created new information is supplied to the mobile body at the next journey via, for example, a floppy.

Thus, the information obtained in the past journey of the mobile body can be used in subsequent journeys, thereby further enhancing information accuracy and hence enhancing the convenience of the system to the user.

The present invention is also characterized by further comprising accumulated-information changing means for writing, when part of the information accumulated in the database is changed, the changed part of the information into the database.

By virtue of this structure, a place name contained in the database can be revised if a corresponding actual place has its name changed. This revised place name information is used as part of new information, which is supplied to the mobile body at the next journey via, for example, of a floppy.

Therefore, the user can drive the mobile body with updated information, without buying, for example, a new CD-ROM. This means that the system is much more convenient to the user.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A traffic support system according to the embodiment of the invention will be described with reference to the accompanying drawings.

Figure 1:
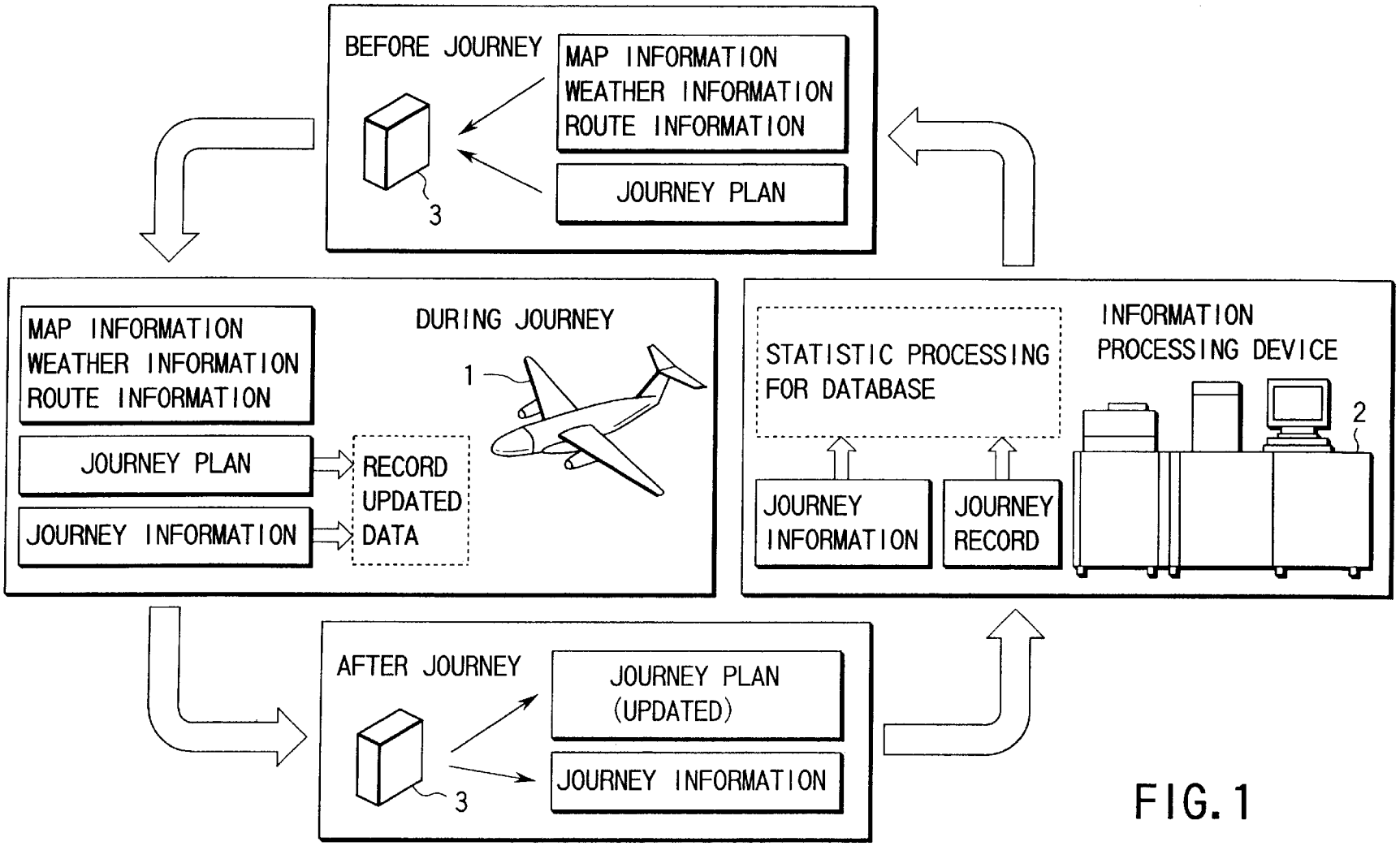
FIG. 1 is a block diagram showing a traffic support system according to the embodiment of the invention.

FIG. 1 shows the traffic support system according to the embodiment of the invention. In FIG. 1, reference numeral 1 denotes an airplane as an example of a mobile body, and reference numeral 2 an information processing device realized as a general-purpose personal computer, a work station, etc. The information processing device 2 has a database that accumulates information such as traffic information and traffic record information relating to the journey of the airplane. This database is stored in a database storage shown in FIG. 3. A programmable data recording device 3 such as a hard disk drive, a DVD-RAM, etc. stores various information items relating to the journey of an airplane 1, which include: for example, route information concerning the route the airplane 1 takes; weather information including forecasted weather and past weather on the flight path and its vicinities of the airplane 1; map information including the contour map of an area and its vicinities where the airplane 1 travels, and a contour map that indicates areas of refuge in case of emergency; flight plan information including the flight plans of the airplane 1 and the flight plans of other airplanes relating to those of the airplane 1; and/or position information obtained from an inertial navigation system, an ILS (Instrument Landing System), etc. These information items are interactively transmitted between the airplane 1 and the information processing device 2 as indicated by the arrows.

Figure 2:
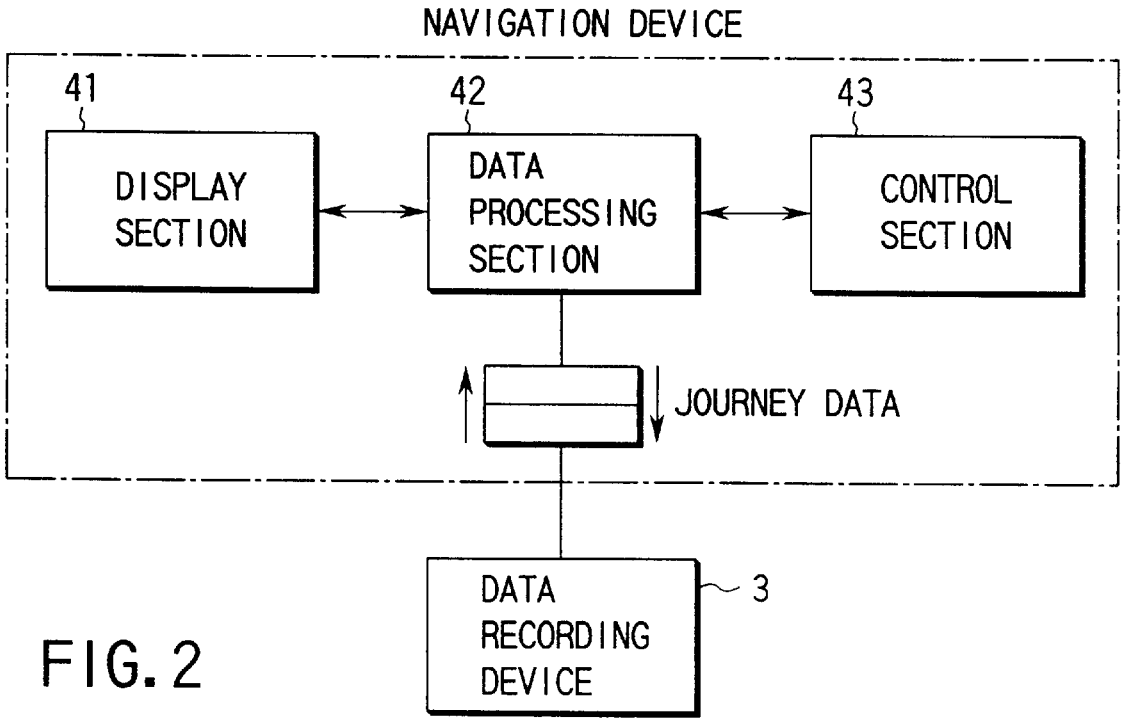
FIG. 2 is a block diagram showing a navigation apparatus installed in an airplane appearing in FIG. 1.

FIG. 2 is a block diagram illustrating the structure of a navigation system incorporated in the traffic support system according to the embodiment of the invention. This navigation system is adapted to be installed and used in the airplane 1, and comprises a display section 41 consisting of, for example, a liquid crystal display, a data processing section 42 functioning as a so-called graphics generator, and a control section 43 for executing various kinds of control relating to the operation of the navigation system, and to be connected to an input/output section (not shown) and function as a human interface. The data recording device 3 shown in FIG. 1 is used in a state in which it is attached to or detached from the data processing section 42.

Figure 3:
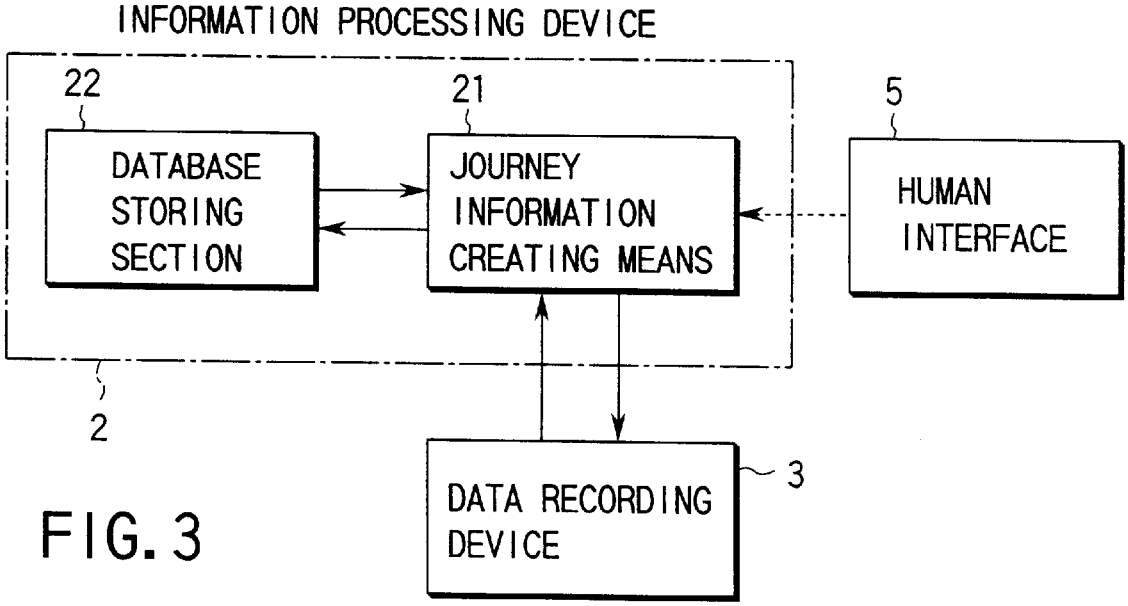
FIG. 3 is a block diagram schematically showing an information processing device appearing in FIG. 1.

FIG. 3 is a block diagram schematically illustrating the structure of the information processing device 2 according to the embodiment of the invention.

As is shown in FIG. 3, the information processing device 2 has means 21 for creating journey information, for example, by software processing or by realizing it as a program recorded in a recording medium. The journey information creating means 21 has a function for creating new information for the flight of the airplane 1 on the basis of information (weather information, flight plans, NOTAM, etc.) input through a human interface 5, position information supplied from the inertial navigation system, data concerning the engine supplied from an engine monitor, data stored in the data recording device 3, and statistical data concerning past weather information accumulated in a database storage 22.

Furthermore, the journey information creating means 21 also has a function for updating data accumulated in the database storage 22 when there is a change in the data, for example, when a place name in the map has been changed.

The operation of the above-described traffic support system will be described.

First, at the stage before flight, various data items created by the information processing device 2 are written into the data recording device 3. In addition to the above-mentioned new data, the data created by the information processing device 2 includes, for example, the position of a planned passing point input, in the conventional case, by the manual input operation of the pilot. The data recording device 3 is brought into the airplane 1 and connected to the data processing section 42 in the airplane 1. On the basis of the data recorded in the data recording device 3, the airplane 1 is controlled.

For example, suppose that when the airplane 1 has been hit by strong and sudden air turbulence during flight, and the captain has performed an appropriate operation. This process is recorded as data in the data recording device 3 under the control of the control section 43.

After the flight of the airplane 1, the recorded data is read from the data recording device 3 through the information processing device 2 and accumulated in the database. Further, the data is analyzed to check "the type of turbulence", "how the airplane escaped from the turbulence", "whether any inappropriate action was taken", or "whether there is a more appropriate action".

Thus, each time the airplane 1 flies, data obtained during the flight is accumulated as a database in the information processing device 2. The accumulated data is used for, for example, training the crews. In general, a large amount of money is necessary to train a crew or a pilot of an airplane. However, if data obtained from an actual flight can be used for training, it results in a significant cut in expenditure. Moreover, data obtained from an actual flight may be used as valuable information for enhancing the capability of a crew or a pilot to overcome a crisis.

Furthermore, data concerning, for example, the position of a planned passing point input, in the conventional case, by the manual operation of the pilot is recorded in advance in the data recording device 3 by means of the information processing device 2, and brought into the airplane 1.

Accordingly, the labor hour of the pilot can be reduced, which means that the stress on the pilot can be reduced, and a mistake in data input due to human error can be prevented.

In addition, data relating to the flight of the airplane 1 can be carried in a state in which it is recorded in the data recording device 3. This is also convenient when, for example, exchanging secret information items in a military mission.

Thus, in the embodiment of the invention, the journey information creating means 21 is provided in the information processing device 2 formed as, for example, a work station. The journey information creating means is adapted to create new information to be used on the next flight, on the basis of information concerning the flight of the airplane 1 and accumulated as a database, and information recorded in the data recording device 3 each time the airplane 1 flies. The obtained information is recorded in the data recording device 3 and supplied to the airplane 1.

Thus, information obtained while the airplane 1 travels is recorded, and the recorded information is appropriately processed and accumulated for effective use in subsequent journeys. As a result, a traffic support system capable of further enhancing its convenience can be provided.

The invention is not limited to the above-described embodiment. For example, information obtained during the flight includes, as well as data relating to the aforementioned turbulence, the direction or speed of the trade wind or the westerlies, the temperature, weather or pressure in the upper air, and the like. By gathering and accumulating such data over one year, statistical data concerning the state of the atmosphere in each season can be created. Safer flights of the airplane 1 can be realized by creating such statistical data using the information processing device 2, writing it into the database storage 22 or the data recording device 3, and reading it therefrom.

Although the above embodiment introduces a system in which the entire data recording device 3, formed as a hard disk drive, is arranged to be portable, this may be modified such that only necessary information is recorded in a recording medium such as a floppy disk, and this recording medium is transported to execute data exchange. Alternatively, data exchange may be executed using radio transmission, without transporting any recording medium.

Further, although, in the above embodiment, information obtained while the airplane is in flight is automatically recorded into the data recording device 3 under the control of the control section 3, this may be modified such that the pilot records some type of data into the data recording device 3 by manual input operation.

Although, in the above embodiment, information obtained while the airplane 1 is in flight is used in the next flight of the airplane 1, it is a matter of course that this information can be used for the journey of another airplane. In other words, the information may be commonly used between a plurality of airplanes. In addition, past information can be used not only for actual air flights, but also for training crews using flight simulation.

The system of FIG. 1 is not limited to the management of airplanes, but can be used by a taxi or bus company to manage a plurality of vehicles such as taxies or buses in order to enhance safety and profit performance. In this case, data is created for managing the journeys of a plurality of vehicles such as taxies or buses, in place of the airplane 1 shown in FIG. 1. Specifically, at the stage before each vehicle starts traveling, various data items created by the information processing device 2 provided in a taxi or bus company are written into the data recording device 3. The data created by the information processing device 2 includes information concerning a journey route, a traffic jam or incoming and outgoing people for, for example, any event in an area where the vehicle may circulate, fuel contained in the vehicle, a distance over which the vehicle requires lubrication, lubrication points, and/or expected sales that the vehicle can achieve while traveling. The data recording device 3 is brought into the vehicle and connected to the data processing section 42 installed therein. On the basis of data recorded in the data recording device 3, the vehicle starts running.

If the vehicle gets in a bad traffic jam during a journey, and finds a detour and gets out of it, the route the vehicle takes is detected from the steering operation and recorded in the data recording device 3 under the control of the control section 43. Further, data concerning the total number of passengers and the total amount of fares while traveling is recorded as journey data in the data recording device 3 under the control of the control section 43.

The recorded data is read by the information processing device 2 from the data recording device 3 and accumulated in the database after the vehicle finishes traveling. This data is analyzed to check "the cause of the traffic jam", "how the vehicle got out of the traffic jam", "whether any inappropriate action was taken", or "whether there is a more appropriate action". The analysis results are also accumulated in the database.

Thus, each time the vehicle travels, data obtained while traveling is accumulated as a database by the information processing device 2. This accumulated data can be used for, for example, training crews, and can be used as management information for determining whether or not vehicles should be increased in light of a seasonal factor or another factor such as an event.

Moreover, since various data items can be brought into a vehicle in a state in which they are recorded in the data recording device 3, the driver can make an appropriate judgment depending upon the state of traffic. As a result, the stress on the drive reduces.

The present invention is applicable to a traffic support system such as a personal car navigation system, as well as the above-described system of a taxi company. In a personal car navigation system, information concerning, for example, autumn leaves found in a tourist resort, where the driver visited by a car, is accumulated as a database in a personal computer, and used in subsequent journeys by the car. Further, the driver can supply sightseeing information to a provider via the Internet to offer it to other drivers.

The present invention can be modified in various ways without departing from its gist.

As described above in detail, the present invention can provide a traffic support system comprising database storing means storing a database that is obtained by accumulating information concerning the journey of the mobile body, and information creating means for creating new information for the journey of the mobile body on the basis of the information accumulated in the database and information obtained in the past journeys of the mobile body. This new information is supplied to the mobile body in the next journey. Thus, the information obtained in the journey of the mobile body is used by the mobile body in subsequent journeys, which means that the convenience of the system is enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An aircraft support system for providing an aircraft pilot with journey information concerning a flight of the aircraft, comprising:

a portable recording device;

an information processing device including:

a database storage section configured to store a database including route information concerning a route of the aircraft, weather information on a flight path of the aircraft, map information concerning a contour map of an area where the aircraft travels, flight plan information concerning a flight plan of airplanes, and aircraft data concerning the aircraft, and a journey information creating section configured to create journey information based on the database stored in the database storage, the journey information creating section being connectable to the portable recording device to write the journey information on the portable recording device;

a navigation device, installed in the aircraft, configured to guide the aircraft pilot based on the journey information, including:

a data processing section, connectable to the portable recording device, configured to process the journey information stored in the portable recording device, and accumulate flight data concerning the flight of the aircraft during the flight of the aircraft, a display section configured to display the journey information, and a control section configured to control the display section and the portable recording device and to store the flight data in the portable recording device, the flight data stored in the portable recording device being transferred to the database storage to prepare new journey information to be utilized in a next flight plan, when the portable recording device is connected to the journey information creating section after the flight of the aircraft.

2. The aircraft support system to claim 1, wherein the information processing device includes a processing section configured to statistically process the flight data and create the database.

* * * * *